US007328470B2

(12) United States Patent
Harris, Jr. et al.

(10) Patent No.: US 7,328,470 B2
(45) Date of Patent: Feb. 12, 2008

(54) FOLDABLE MASSAGING BED REST

(75) Inventors: Kenneth David Harris, Jr., Nashua, NH (US); Stephen R. Lyman, Hudson, NH (US); Joseph Neil Gleason, Milford, NH (US); Steven H. Schwartz, Bedford, NH (US); Rudy Woodard, Boston, MA (US)

(73) Assignee: Brookstone Purchasing, Inc., Merrimack, NH (US)

( * ) Notice: Subject to any disclaimer, the term of this patent is extended or adjusted under 35 U.S.C. 154(b) by 0 days.

(21) Appl. No.: 10/783,085

(22) Filed: Feb. 20, 2004

(65) Prior Publication Data

US 2005/0193495 A1 Sep. 8, 2005

(51) Int. Cl.
*A47C 20/00* (2006.01)
*A47C 21/04* (2006.01)

(52) U.S. Cl. ..... 5/633; 5/421; 5/933; 297/230.1; 601/57

(58) Field of Classification Search ..... 5/933, 5/633, 630, 421; 297/230.1, 230.11, 230.12, 297/411.32; 601/15, 18, 57, 48, 49
See application file for complete search history.

(56) References Cited

U.S. PATENT DOCUMENTS

| | | | | |
|---|---|---|---|---|
| 2,105,336 | A * | 1/1938 | Smith | 5/632 |
| 3,137,012 | A * | 6/1964 | Halterman | 5/633 |
| 3,273,174 | A * | 9/1966 | Cassini | 5/633 |
| 3,542,427 | A * | 11/1970 | Herpel et al. | 297/411.32 |
| 3,654,454 | A | 4/1972 | Olesen | |
| 3,736,920 | A | 6/1973 | Mathers et al. | |
| 3,879,086 | A | 4/1975 | Moceri | |
| 4,006,739 | A | 2/1977 | Wahl | |
| 4,022,195 | A | 5/1977 | Meyer et al. | |
| 4,233,649 | A | 11/1980 | Scheer et al. | |
| 4,686,967 | A | 8/1987 | Hashimoto et al. | |
| 4,868,888 | A | 9/1989 | Dayton | |
| 5,020,517 | A | 6/1991 | Foster, Jr. et al. | |
| 5,033,458 | A | 7/1991 | Sperr | |
| 5,184,607 | A | 2/1993 | Hwang | |
| 5,188,096 | A | 2/1993 | Yoo | |
| 5,316,369 | A | 5/1994 | Kanda | |
| 5,335,962 | A | 8/1994 | Gera | |

(Continued)

FOREIGN PATENT DOCUMENTS

| | | |
|---|---|---|
| GB | 390673 | 4/1933 |

OTHER PUBLICATIONS

Brookstone, Bed Rest Massager, www. brookstone.com (Retail Internet website and electronic catalog), Dec. 22, 2002.

(Continued)

*Primary Examiner*—Tara L. Mayo
(74) *Attorney, Agent, or Firm*—Nixon Peabody, LLP

(57) ABSTRACT

A foldable massaging bed cushion for supporting a person in a sitting position has a backrest with two side edges, two armrests rotatably coupled to the backrest, and one or more massaging units within the backrest. The two armrests can rotate from a sitting position to a folded position along the two side edges of the backrest. The foldable massaging bed cushion can also have one or more heating units and one more massaging units located within the backrest and a control panel to control the massaging units and heating units.

32 Claims, 7 Drawing Sheets

U.S. PATENT DOCUMENTS

| | | | | |
|---|---|---|---|---|
| 5,411,468 | A | 5/1995 | Chen | |
| 5,423,098 | A * | 6/1995 | Swezey et al. | 5/633 |
| 5,429,585 | A | 7/1995 | Liang | |
| 5,453,586 | A | 9/1995 | Stottman | |
| 5,460,598 | A | 10/1995 | Yamasaki et al. | |
| 5,462,515 | A | 10/1995 | Tseng | |
| 5,503,457 | A | 4/1996 | Rosado | |
| 5,613,222 | A | 3/1997 | Guenther | |
| 5,696,574 | A | 12/1997 | Schwaegerle | |
| 5,713,832 | A | 2/1998 | Jain | |
| 5,827,206 | A | 10/1998 | Lunter | |
| 5,836,546 | A | 11/1998 | Sakaue et al. | |
| 5,836,900 | A | 11/1998 | Leventhal | |
| 5,868,687 | A | 2/1999 | Tedesco | |
| 5,895,365 | A * | 4/1999 | Tomlinson | 601/57 |
| 6,012,778 | A | 1/2000 | Peterson | |
| 6,077,238 | A | 6/2000 | Chung | |
| 6,102,476 | A | 8/2000 | May et al. | |
| 6,120,468 | A | 9/2000 | Tseng | |
| 6,126,233 | A | 10/2000 | Gaetano et al. | |
| 6,154,690 | A | 11/2000 | Coleman | |
| 6,212,719 | B1 | 4/2001 | Thomas et al. | |
| 6,388,345 | B1 | 5/2002 | Stimpson | |
| 6,682,494 | B1 * | 1/2004 | Sleichter et al. | 601/57 |
| 6,814,709 | B2 * | 11/2004 | Schwartz et al. | 601/57 |
| 2003/0028132 | A1 | 2/2003 | Bastia et al. | |

OTHER PUBLICATIONS

Brookstone, BedLounge, www.brookstone.com (Retail Internet website and electronic catalog), Nov. 21, 2005.

Tactica International, IGIA Contour Rest Massaging Back Cushion, www.igia.com (Retail Internet website), Nov. 21, 2005.

Tactica International, IGIA Contour Rest Massaging Lumbar Light Pillow, IGIA/EPIL-STOP catalog, Jan. 1, 2001.

* cited by examiner

FOLDABLE MASSAGING BED REST

FIELD OF THE INVENTION

The present invention is generally related to a massaging bed rest, and more particularly is related to a massaging bed rest with rotatable armrests.

BACKGROUND OF THE INVENTION

Cushioned bed loungers are known in the art. Bed loungers normally include a back portion and arm rests or elbow rests. The back portion may be contoured and may include a padded neck or head rest. Chair back massagers also are known in the art. One form of prior art back massager is in the form of a pad containing a mechanical massage arrangement powered by electricity. In use, a person places the massager against the back of a chair, automobile seat, or couch and then sits downs and leans back against the massaging device. Other configurations have the massaging elements built into the seat back, for example in a lounge chair or automobile seat. Such massagers include a back portion including a massaging element driven by an electric motor.

U.S. Pat. No. 5,895,365, by Tomlinson, discloses a bed rest cushion for providing a vibrating massage including a back portion and two armrests. The two armrests are pivotally coupled to the back portion. However, the armrests are coupled to allow the armrest to rotate outward from the back portion. The armrests do not rotate about the sides of the back portion. The rotation of the bed rest cushion described by Tomlinson does not facilitate storage of the bed rest cushion, nor using the bed rest as a flat massaging cushion for placement in a chair or under the chest of a person when laying down on their stomach.

Thus, a heretofore unaddressed need exists in the industry to address the aforementioned deficiencies and inadequacies.

SUMMARY OF THE INVENTION

In one aspect, the invention features a foldable massaging bed cushion for supporting a person in a sitting position. The massaging bed cushion contains a backrest with two side edges, two armrests rotatably coupled to the backrest, and one or more massaging units within the backrest. The two armrests can rotate from a sitting position to a folded position along the two side edges of the backrest.

The two armrests can be perpendicular to the backrest in the sitting position. In addition, the two armrests can rotate from zero to one hundred and eighty degrees from the backrest. The sitting position is formed by rotating the two armrests from about forty-five to about one hundred and thirty-five degrees from the backrest. Preferably, the sitting position is formed by rotating the two armrests to ninety degrees (90°) from the backrest. The backrest and the two armrests can form nearly a rectangular top profile in the folded position.

Other features and advantages of the present invention will be or become apparent to one with skill in the art upon examination of the following drawings and detailed description. It is intended that all such additional features and advantages be included within this description, be within the scope of the present invention, and be protected by the accompanying claims.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

Figure 1:
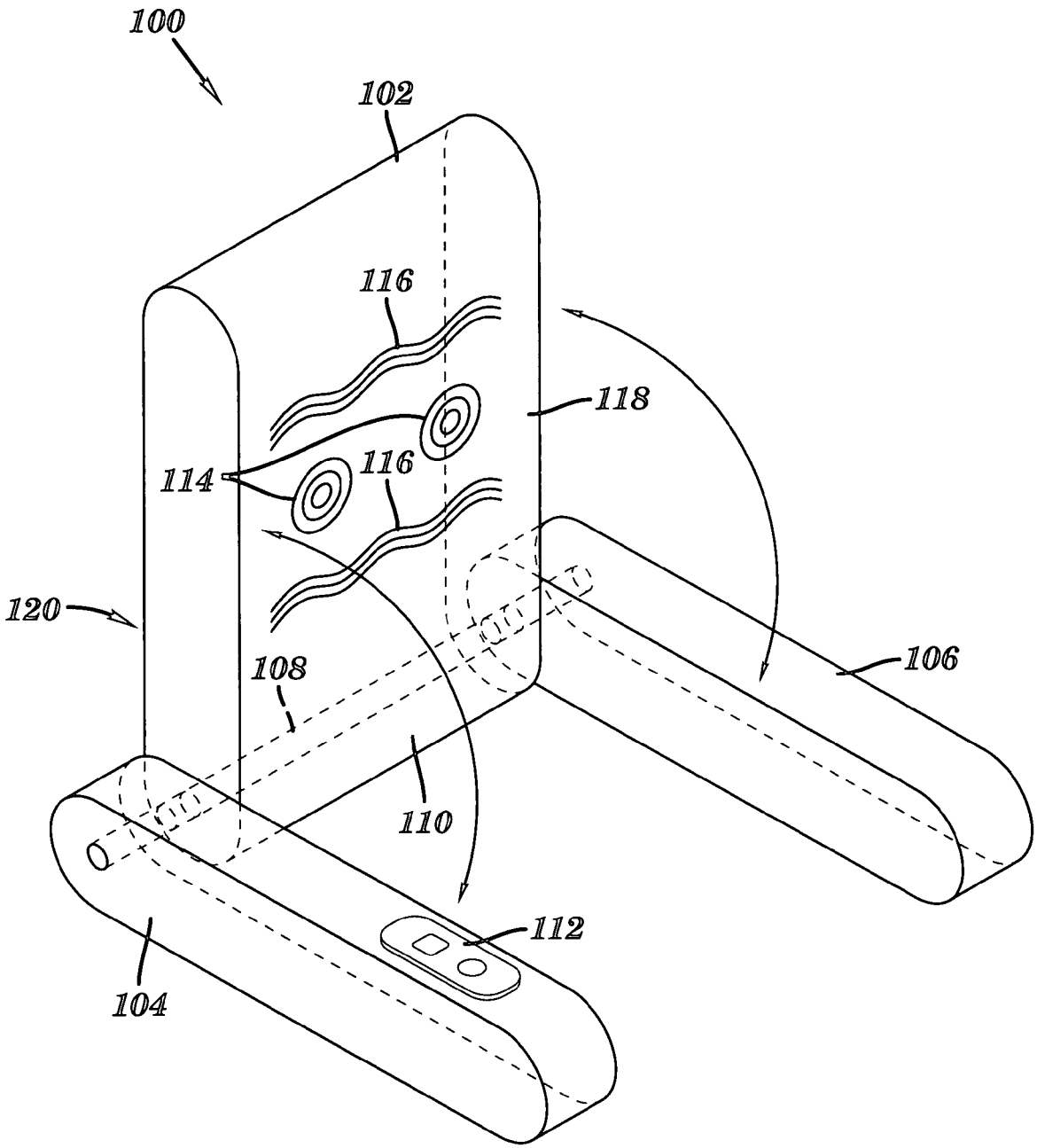
FIG. 1 is a perspective view of the massaging cushion unfolded for use in a sitting position, in accordance with a first exemplary embodiment.
Figure 2:
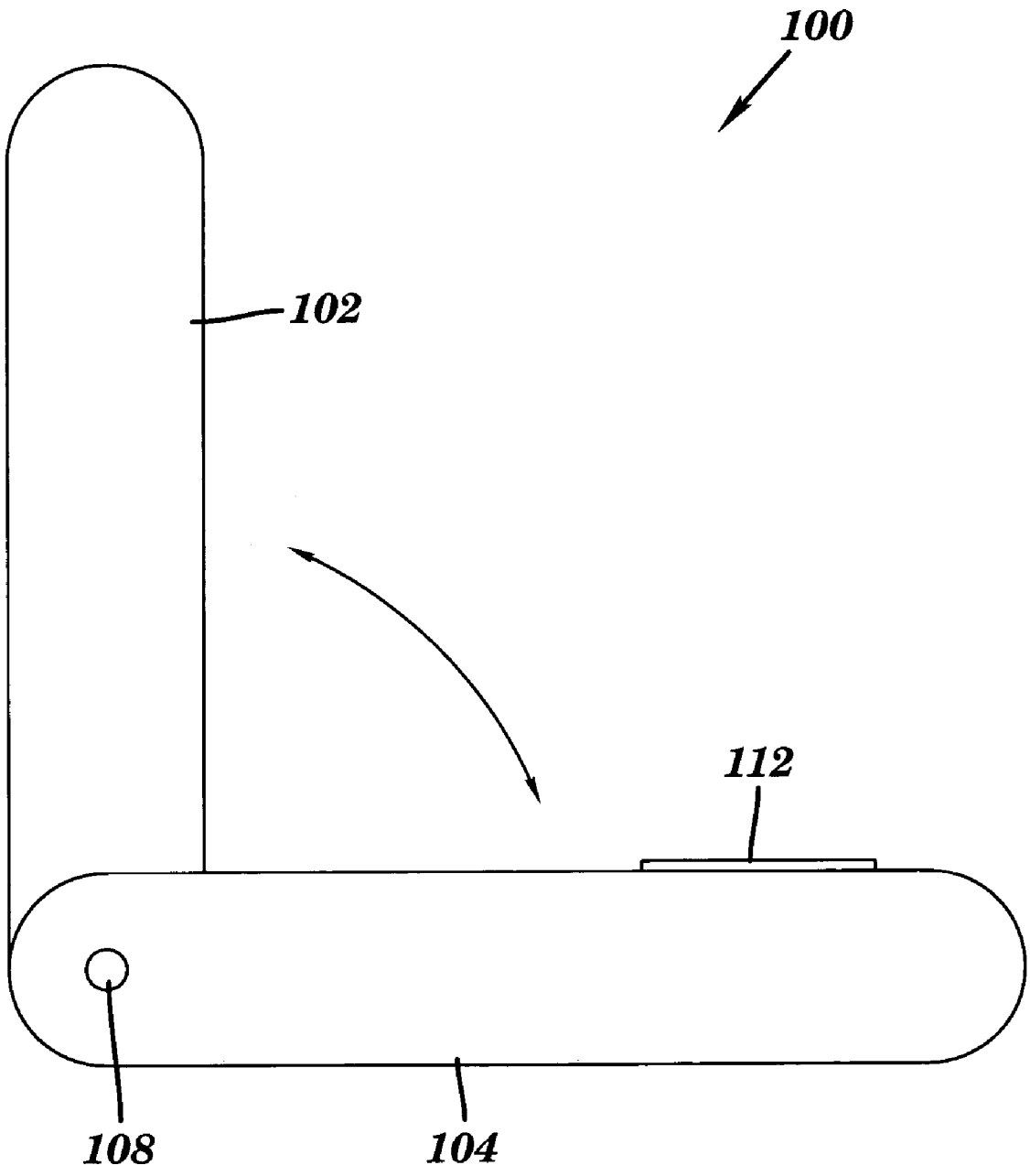
FIG. 2 is a side view of the massaging cushion of FIG. 1 unfolded for use in the sitting position.
Figure 3:
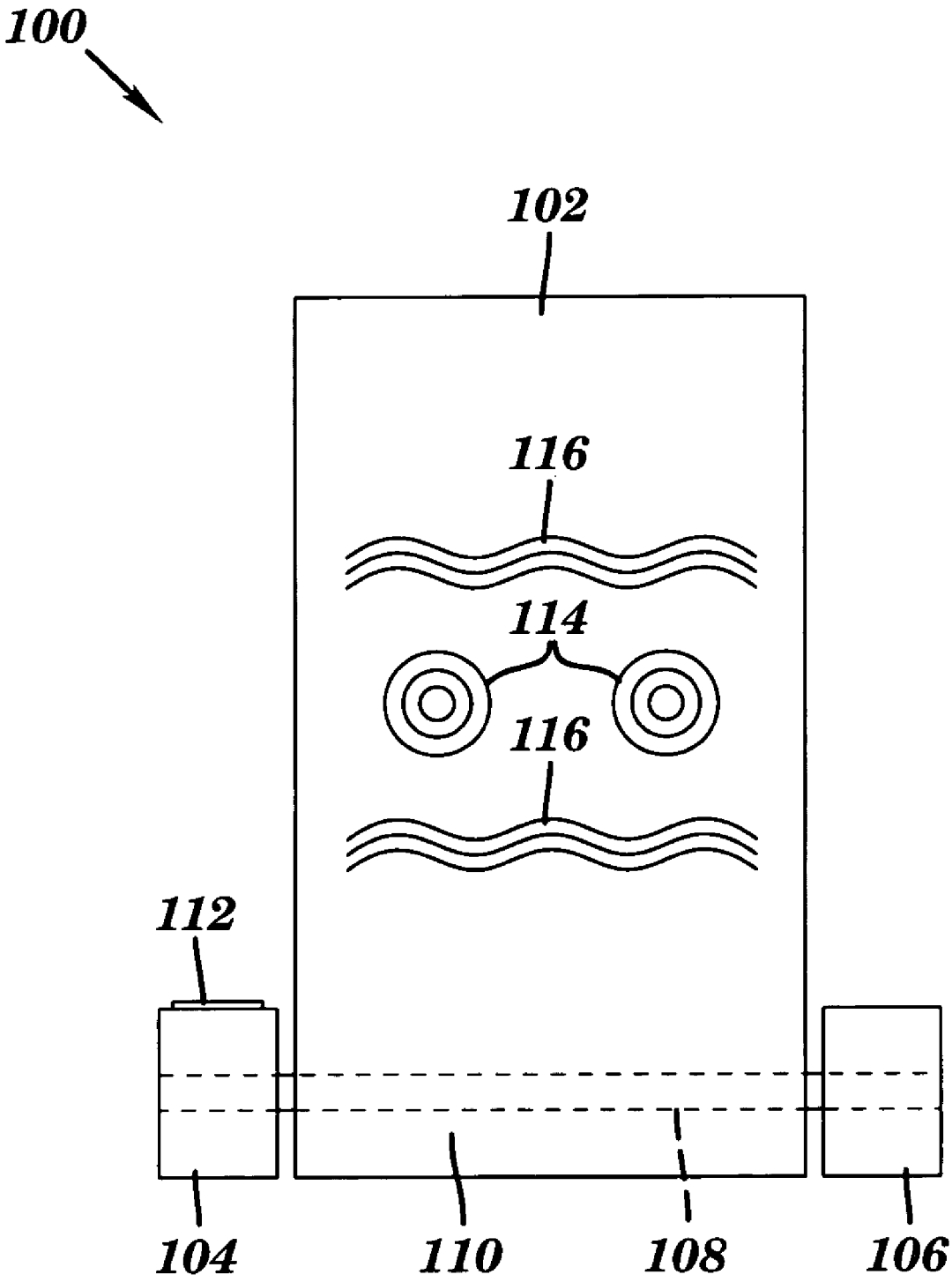
FIG. 3 is a front view of the massaging cushion of FIG. 1 unfolded for use in the sitting position.

FIG. 1 is a perspective view, FIG. 2 is a side view, and FIG. 3 is a front view of the massaging cushion 100 unfolded for use in a sitting position, in accordance with a first exemplary embodiment of the invention. The massaging cushion 100 comprises a backrest 102, a right armrest 104, and a left armrest 106. An axle 108 couples the right armrest 104 and left armrest 106 to the backrest 102. In addition, the axle 108 runs through a lower portion 110 of the backrest 102. The axle 108 allows the right armrest 104 and left armrest 106 to rotate about the backrest 102 as indicated by the arrows shown in FIG. 1 and FIG. 2. When the massaging cushion 100 is unfolded into a sitting position, the user sits between the right armrest 104 and left armrest 106. The right and left arms of the user rest on the right armrest 104 and the left armrest 106, respectively. The back of the user rests on a front surface 118 of the backrest 102 of the massaging cushion 100. The weight of the arms and upper body of the user rests upon the right armrest 104 and left armrest 106. The weight on the armrests 104 and 106 upon the floor provides a frictional force that prevents the backrest 102 from sliding backwards when using the massaging cushion 100 in the sitting position. Alternatively, while resting on the massaging cushion 100, a back surface 120 of the backrest 102 may be leaned against a wall, a back portion of a bed, or any other surface that will prevent the backrest 102 from moving backward.

The axle 108 allows the right armrest 104 and left armrest 106 to rotate about the backrest 102. In the first exemplary embodiment, the right armrest 104 and left armrest 106 can rotate one hundred and eighty degrees from the backrest 102. When the massaging cushion 100 is in the sitting position, the right armrest 104 and left armrest 106 are rotated between about ninety degrees to about one hundred and twenty degrees from the backrest 102. The lower backside of the user prevents the backrest 102 from rotating out of the sitting position. The user can adjust the slant of the backrest 102 by moving the lower backside of the user closer or further away from the lower portion 110 of the backrest 102. By moving the lower backside of the user closer to the backrest 102, the angle between the armrests 104 and 106 and the backrest 102 is decreased. By moving the lower backside of the user further away from the lower portion 110 of the backrest 102, the backrest 102 is allowed to rotate, increasing the angle between the armrests 104 and 106 and the backrest 102.

The left armrest 106 and right armrest 104 may rotate about the axle 108 together or separately. As an example, movement of the left armrest 106 may force the right armrest 104 to rotate with the left arm rest 106. Alternatively, the left armrest 106 may rotate about the axle 108 independent from the right armrest 104 These different examples of movement of the left armrest 106 and right armrest 104 may be made possible by a series of gears, joints, or any other device known by those having ordinary skill in the art that may allow and/or limit rotation about the axle 108.

In another embodiment, a rotation latch (not shown) can be used to prevent the backrest 102 from rotating out of the sitting position. The rotation latch prevents the right armrest 104 and left armrest 106 from rotating beyond a desired angle from the backrest 102. For example, the rotation latch can allow the backrest 102 to rotate one hundred degrees from the right armrest 104 and the left armrest 106. This allows the massaging cushion 100 to remain in the sitting position without relying on support from the arms and lower backside of the user. In addition, the rotation latch can also be an adjustable latch that allows the user to set a maximum angle of rotation. This allows the user to customize and set the maximum angle between the armrest 104, 106 and the backrest 102 that is allowed by the massaging cushion 100.

A control panel 112 located on a top surface of the right armrest 104 allows the user to activate one or more massaging units 114 and one or more heating units 116. The location of the control panel 112 provides easy access by the hands of the user when the user is being supported by the massaging cushion 100 adjusted to the sitting position. The control panel 112 is not limited to being located on the top surface of the right armrest 104. The control panel 112 can instead be mounted on a variety of different locations and surfaces of the massaging cushion 100. The control panel 112 can contain various displays, switches, and knobs used to control the one or more massaging units 114 and the one or more heating units 116. For example, the knobs or switches can be used to control the amount of heat provided by the heating units 116. The knobs or switches can also be used to control the massaging intensity and motion of the massaging units. The display can be a Light Emitting Diode (LED) display that shows the current settings of the one or more massaging units 114 and one or more heating units 116.

The one or more massaging units 114 can be located within the backrest 102. In addition, the one or more massaging units 114 can be built into the cushion of the backrest 102. The massaging units 114 can be a variety of massaging devices arranged within the backrest 102, for example, but not limited to, massage motors, pulsating transducers, and powered rollers. The location of the massaging units 114 can be a variety of locations and surfaces on the massaging cushion 100, for example, but not limited to, the top surface or inside surface of the armrests 104 and 106.

Along with the one or more massaging units 114, the massaging cushion 100 can also have the one or more heating units 116. Similar, to the massaging units 114, the one or more heating units 116 can also be built into the cushion of the backrest 102. The heating units 116 also can be located in a variety of locations and surfaces of the massaging cushion 100. In addition, the heating units 116 may be located within the armrests 104, 106. During use, the heating unit 116 can generate heat when current is applied to the heating element. Other means for providing heat would be known by those having ordinary skill in the art.

The control panel 112 can regulate both the one or more massaging units 114 and the heating units 116. The control panel 112 can also selectively activate the massaging units 114 and heating units 116 in a variety of patterns, providing different massaging sequences. These sequences can be stored in a memory of the control panel 112. A user can select a desired sequence on the control panel 112 and the control panel 112 can activate the different massaging units 114 and heating units 116 based on the selected pattern of the user.

Figure 4A:
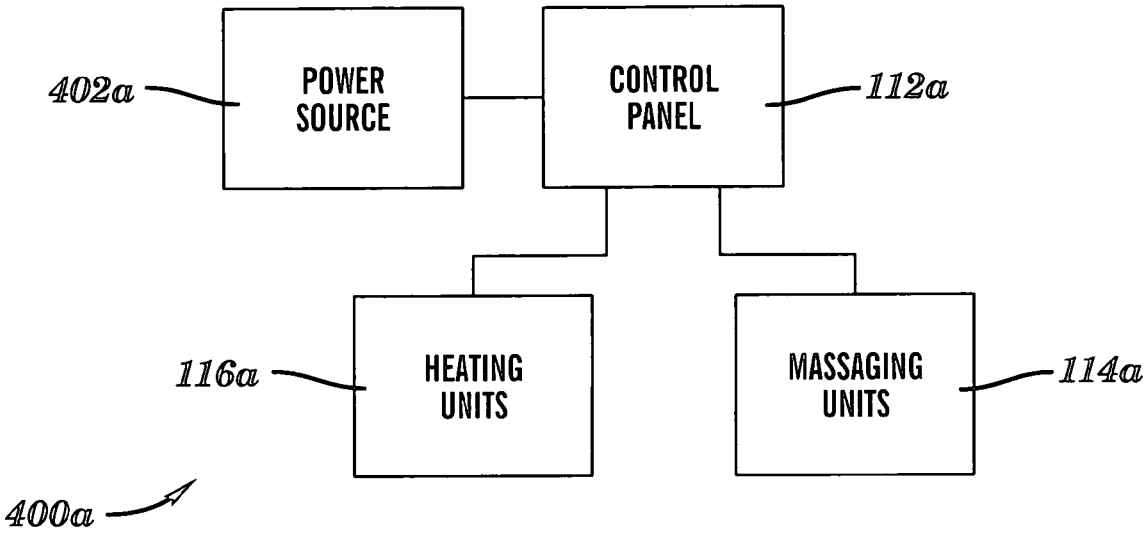
FIG. 4*a* is a block diagram illustrating interaction of the interior components of the massaging cushion of FIG. 1, in accordance with the first exemplary embodiment of the invention.

FIG. 4*a* is a block diagram illustrating interaction of interior components 400*a* of the massaging cushion 100 in accordance with a first exemplary embodiment of the invention. The control panel 112*a* can be electrically coupled to each massaging unit 114*a* and each heating unit 116*a*. A power source 402*a* supplies the power to operate the control panel 112*a*. The control panel 112*a* selectively supplies power to each of the massaging units 114*a* and each of the heating units 116*a* depending on the control panel 112*a* setting. The control panel 114*a* controls each massaging unit 114*a* and each heating unit 116*a* by varying the amount of current supplied to each massaging unit 114*a* and each heating unit 116*a*.

Figure 4B:
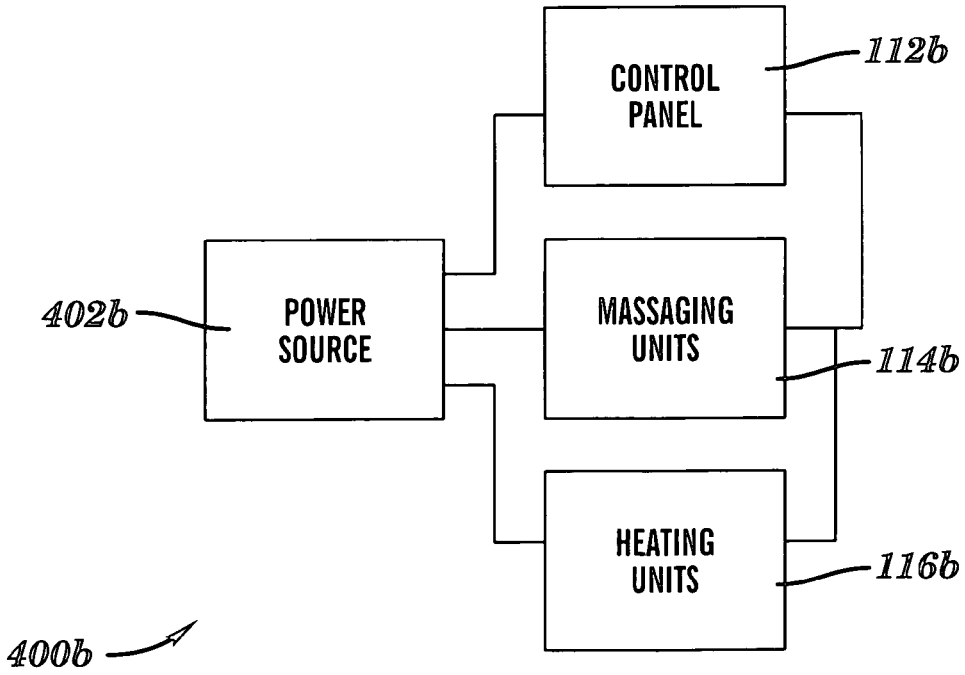
FIG. 4*b* is a block diagram illustrating the interaction of the interior components of the massaging cushion of FIG. 1, in accordance with a second exemplary embodiment of the invention.

FIG. 4*b* is a block diagram illustrating interaction of interior components 400*b* of the massaging cushion 100 in accordance with a second exemplary embodiment of the invention. The power source 402*b* can be electrically coupled to the control panel 112*b*, the one or more massaging units 114*b*, and the one or more heating units 116*b*. The power source 402*b* supplies power directly to each component. The control panel 112*b* can be electrically coupled to each massaging unit 114*b* and each heating unit 116*b* or the control panel 112*b* can be connected to each massaging unit 114*b* and each heating unit 116*b* by wireless communication. The control panel 112*b* signals each of the massaging units 114*b* and each of the heating units 116*b* by electrical pulse or a wireless communication protocol based on the desired setting selected by the user via the control panel 112*b*. Each of the massaging units 114*b* and each of the heating units 116*b* respond to the signals by adjusting to the desired setting. For example, a heating unit 116*b* that receives the signals from the control panel 112*b* to increase the temperature, would increase the current to the heating unit 116*b*.

The power source 402*a* and 402*b* can be a battery mounted within the backrest 102, the right armrest 104, or the left armrest 106. In addition to the power source 402*a*, 402*b* being a battery, the power source 402*a*, 402*b* can also be an electrical plug that enters through a surface on the massaging cushion 100. The user would plug the electrical plug into a wall socket to supply the power to run the control panel 112, the one or more massaging units 114, and the one or more heating units 116. The power source 402*a*, 402*b* can also be a combination of the electrical plug and the battery. For example, the battery can be a rechargeable battery that supplies the power for the massaging cushion 100 when the massaging cushion 100 is used in a location remote from a wall socket. The massaging cushion 100 can also have the electrical plug used to recharge the battery or supply power when the massaging cushion 100 is used in a location within reach of a wall socket.

The massaging cushion 100 can be constructed of a solid frame with foam or padding material located between the solid frame and a cover. The cover can be made from a variety of materials, for example, but not limited to, fabric, leather, or vinyl. The solid frame can be made of a variety of materials, for example, wood, metal, or plastic. Instead of a solid frame surrounded by padding material, the frame can also be constructed using a semi-hard foam rubber. The semi-hard foam rubber would not require the additional padding material. The control panel 112, massaging units 114, and heating units 116 can be supported by the solid frame or the semi-hard foam rubber frame within the massaging cushion 100. The massaging cushion 100 can be constructed to have a relatively flat surface profile as shown in FIGS. 1-3. The massaging cushion 100 can also be constructed to have a more contoured profile that conforms to the contours of the human body.

Figure 5:
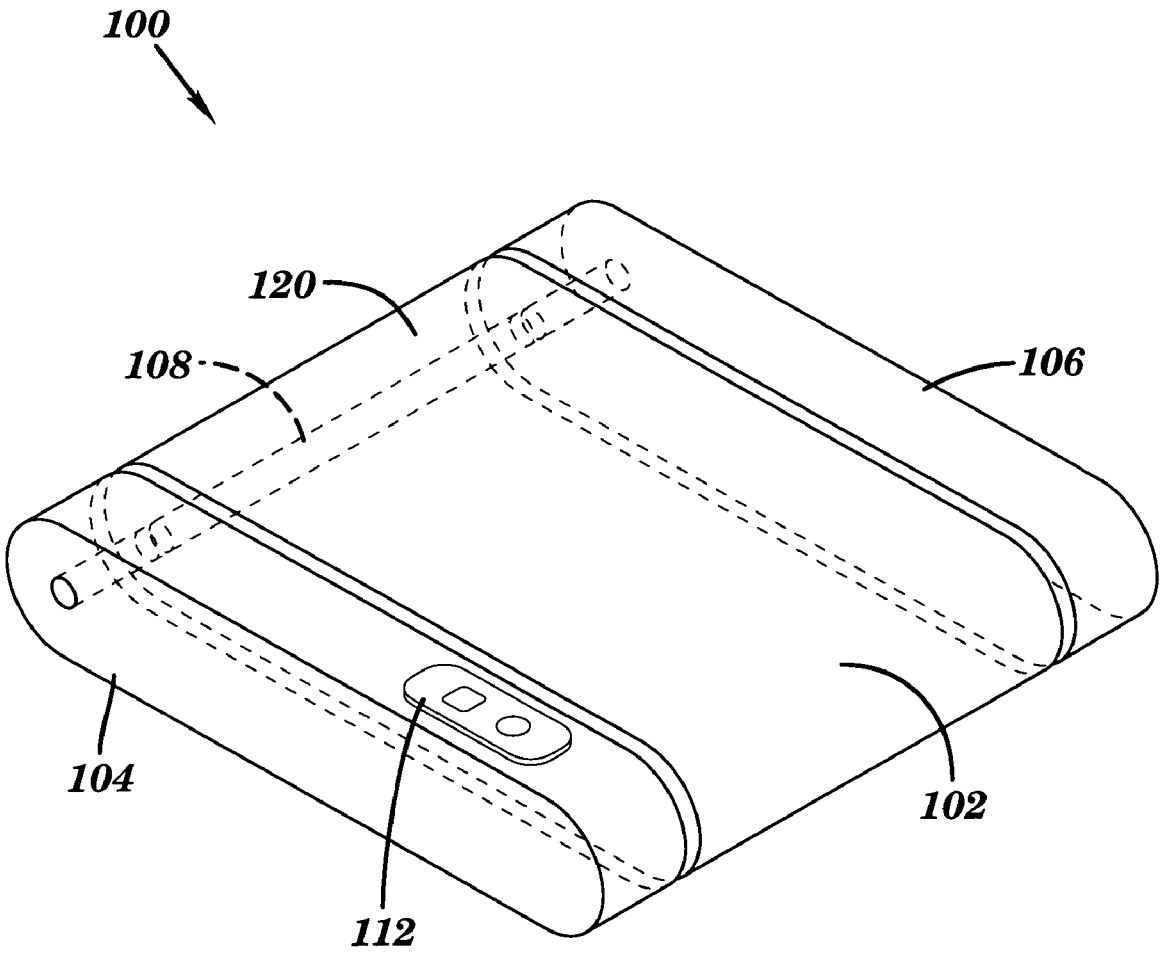
FIG. 5 is a perspective view of the massaging cushion of FIG. 1 folded into a storage position or for use in a laying down position.
Figure 6:
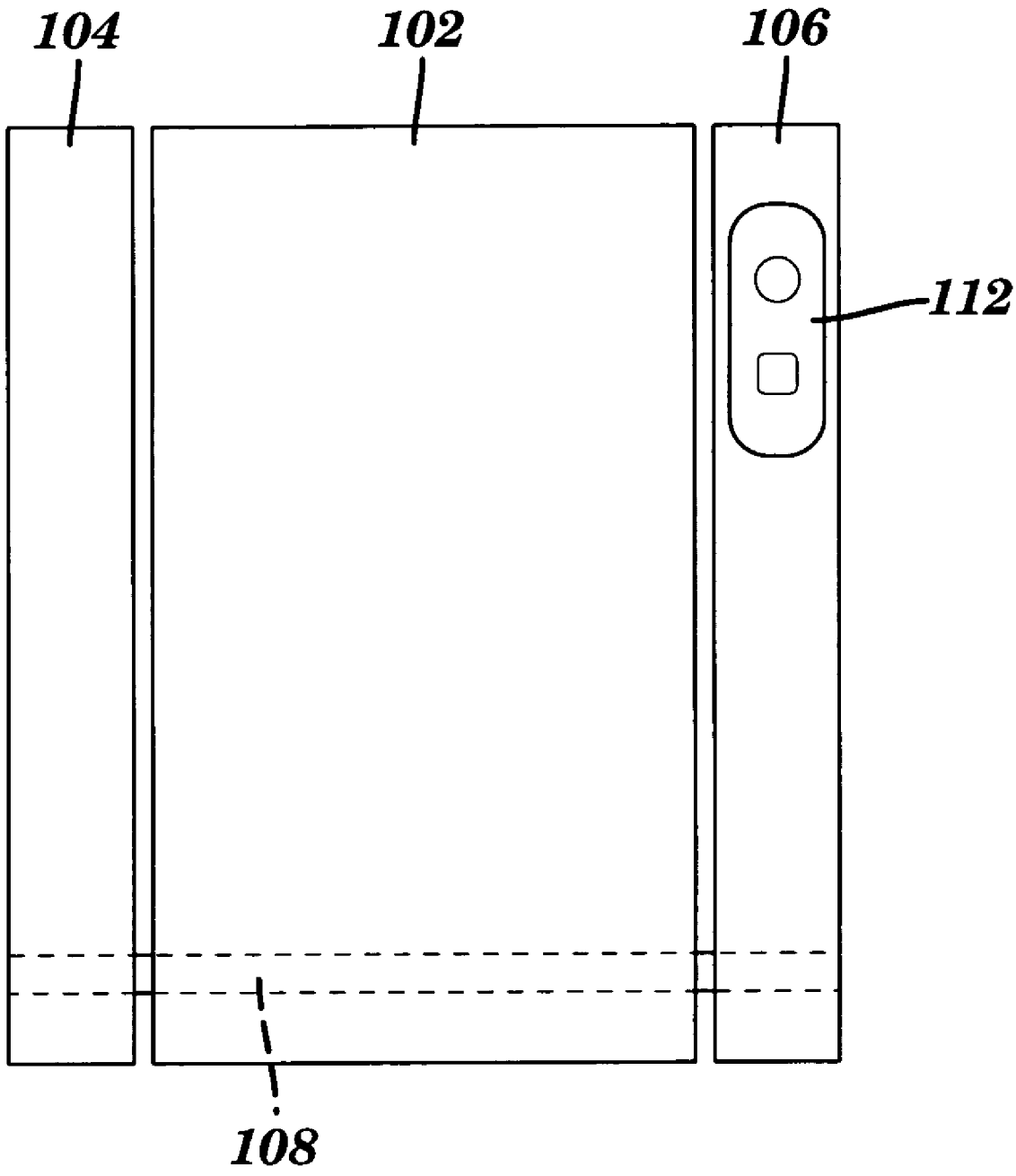
FIG. 6 is a top view of the massaging cushion of FIG. 1 folded into a flattened position for use in a laying down position or for storage in accordance with the first exemplary embodiment of the invention.

FIG. 5 is a perspective view and FIG. 6 is a top view of the massaging cushion 100 folded into a flattened position for use in a lying down position or for storage in accordance with the first exemplary embodiment of the invention. The right armrest 104 and left armrest 106 may be folded inline with the backrest 102. This allows the massaging cushion 100 to have a rectangular shape when in the flattened position to facilitate storage. Due to rectangular shape when in the flattened position, multiple massaging cushions 100 can be stacked vertically or the massaging cushion can be easily stored on a shelf in the folded position. In addition, when in the flattened position, the massaging cushion 100 easily fits within a rectangular storage device, such as, but not limited to, a box.

The massaging cushion 100 can also be used as a massaging pillow in the folded position. The user can sit on top of the massaging cushion 100 while the massaging cushion 100 provides a massage to the lower back and thighs of the user. A user can also use the massaging cushion 100 in the folded position to prop up the chest of the user when the user is lying on their stomach. In this position the massaging cushion 100 can be used to provide a massage to the chest of the user. As previously discussed, the massaging units 114 and heating units 116 can be provided on a variety of surfaces and locations on the massaging cushion 100. The massaging units 114 and heating units 116 can be provided on both the back surface 120 and the front surface 118 of the backrest 102. This allows the user to use the massaging cushion 100 in the sitting position or in the folded position as a pillow while maintaining easy access to the control panel 112. The massaging units 114 and heating units 116 can also be centrally located within the backrest 102 so as to provide a massaging effect and heating to both the back surface 120 and the front surface 118 of the backrest 102 from within the backrest 102.

Figure 7:
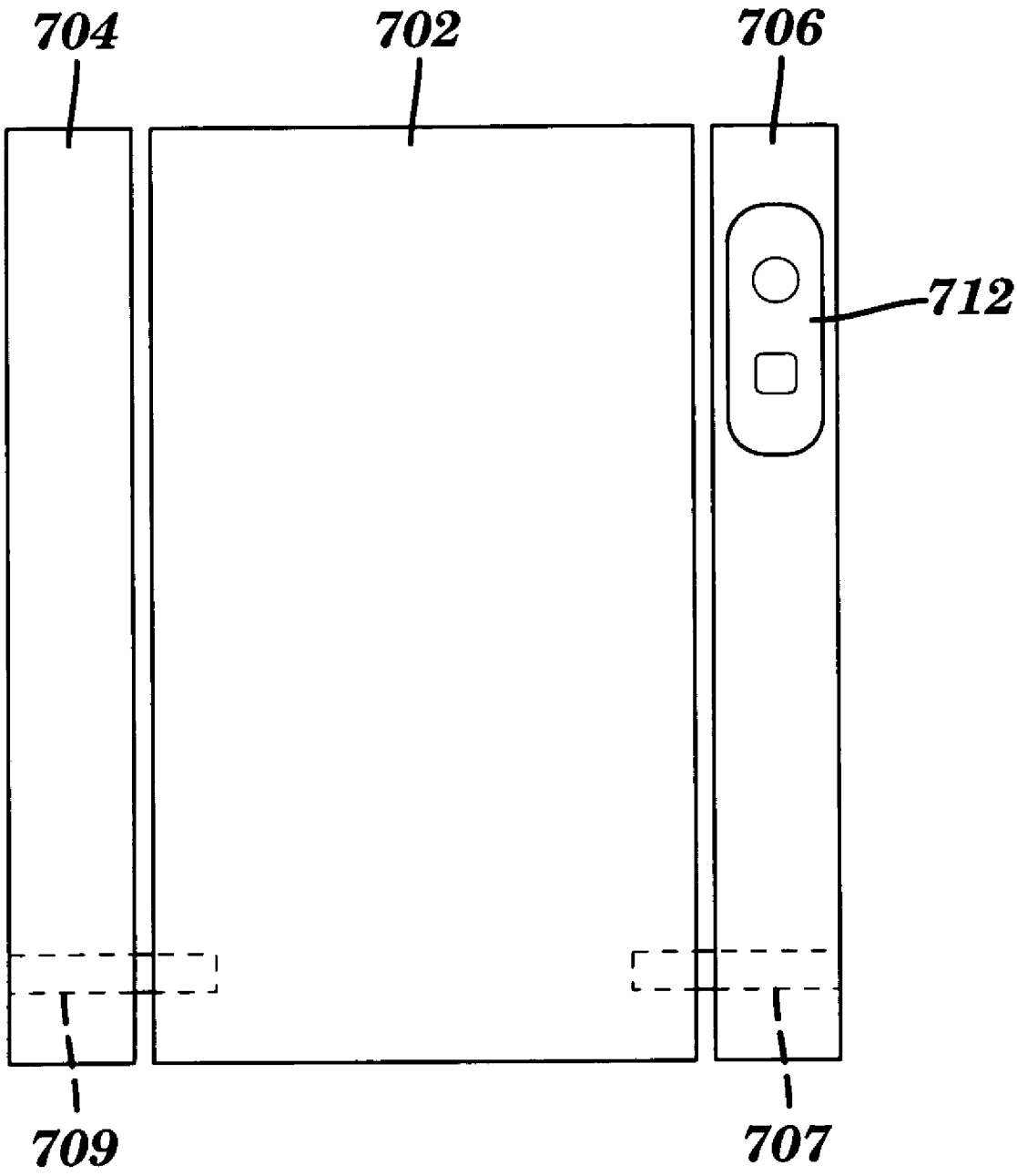
FIG. 7 is a perspective view of a massaging cushion folded into a flattened position for use in a lying down position or for storage in accordance with a third exemplary embodiment of the invention.

FIG. 7 is a top view of the massaging cushion 700 folded into a flattened position for use in a lying down position or for storage in accordance with a third exemplary embodiment of the invention. In the third exemplary embodiment, the axle 108 shown in FIG. 1 does not run all the way through the backrest 102. Instead, in the third exemplary embodiment of the right armrest 706 is coupled to the backrest 702 by a right axle 707 and the left armrest 704 is coupled to the backrest 702 by a left axle 709. The right axle 707 and left axle 709 allow the right armrest 706 and left armrest 704 to rotate about the backrest 702. The third exemplary embodiment also allows the right armrest 706 and left armrest 704 to rotate independently about the backrest 702.

It should be emphasized that the above-described embodiments of the present invention are merely possible examples of implementations merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention and protected by the following claims.

What is claimed is:

1. A seatless massaging bed cushion for supporting a person in a sitting position, comprising:

a backrest with two elongate side edges;

two elongate armrests, each with a longitudinal axis, rotatably coupled directly to the backrest wherein the two armrests can rotate, while remaining coupled to the backrest, from a sitting position to a folded position, and wherein, in the folded position, the longitudinal axes of the armrests extend along the two side edges of the backrest; and one or more massaging units within the backrest.

2. The massaging bed cushion of claim 1, wherein the two elongate armrests are perpendicular to the backrest in the sitting position.

3. The massaging bed cushion of claim 1, further comprising: one or more latches that prevent the two elongate armrests from rotating about the backrest beyond the sitting position.

4. The massaging bed cushion of claim 1, wherein the backrest and the two elongate armrests form nearly a rectangular top profile in the folded position.

5. The massaging bed cushion of claim 1, wherein the one or more massaging units are massaging motors.

6. The massaging bed cushion of claim 1, wherein the one or more massaging units are pulsating transducers.

7. The massaging bed cushion of claim 1, further comprising:

a control panel wherein the control panel is coupled by electrical communication to the one or more massaging units.

8. The massaging bed cushion of claim 7, wherein the control panel is located in one of the two elongate armrests.

9. The massaging bed cushion of claim 1, further comprising a control panel and one more heating sources located within the backrest and controlled by the control panel, wherein the control panel is coupled by electrical communication to the one or more heating units.

10. The massaging bed cushion of claim 1, further comprising a power supply wherein the power supply is coupled by electrical communication to a control panel.

11. The massaging bed cushion of claim 10, wherein the power supply is a battery.

12. The massaging bed cushion of claim 1, wherein the backrest comprises a rectangular frame covered by a cushion and a fabric.

13. The massaging bed cushion of claim 1, wherein the two armrests are coupled to the backrest by an axle that runs through a bottom portion of the backrest.

14. A massaging bed cushion for supporting a person in a sitting position, comprising:

a backrest with two elongate side edges;

two elongate armrests, each with a longitudinal axis, rotatably coupled to the backrest wherein the two armrests can rotate, while remaining coupled to the backrest, from a sitting position to a folded position, and wherein, in the folded position, the longitudinal axes of the armrests extend along the two side edges of the backrest; and one or more massaging units within the backrest;

wherein the two elongate armrests rotate to a position between zero to one hundred and eighty degrees from the backrest.

15. A massaging bed cushion for supporting a person in a sitting position, comprising:

a backrest with two elongate side edges;

two elongate armrests, each with a longitudinal axis, rotatably coupled to the backrest wherein the two armrests can rotate, while remaining coupled to the backrest, from a sitting position to a folded position, and wherein, in the folded position, the longitudinal axes of the armrests extend along the two side edges of the backrest; and one or more massaging units within the backrest;

wherein the sitting position is formed by rotating the two elongate armrests to a position between about forty-five to about one hundred and thirty-five degrees from the backrest.

16. A seatless massaging cushion, comprising:

a backrest having an elongate right side and elongate left side;

an elongate right armrest rotatably coupled directly to the elongate right side of the backrest;

an elongate left armrest rotatably coupled directly to the elongate left side of the backrest wherein the elongate right armrest and the elongate left armrest can rotate, while remaining coupled to the backrest, into a folded position with the elongate right armrest and elongate left armrest positioned adjacent to, and extending along, the elongate right side and the elongate left side of the backrest, respectively; and one or more massaging units located within the backrest.

17. The massaging cushion of claim 16, wherein the elongate right armrest and the left armrest rotate to form a sitting position.

18. The massaging cushion of claim 16, further comprising one or more latches that prevent the elongate right armrest and elongate left armrest from rotating about the backrest beyond the sifting position.

19. The massaging cushion of claim 16, wherein the backrest, the elongate right armrest, and the elongate left armrest form nearly a rectangular top profile in the folded position.

20. The massaging cushion of claim 16, wherein the one or more massaging units are massaging motors.

21. The massaging cushion of claim 16, wherein the one or more massaging units are pulsating transducers.

22. The massaging cushion of claim 16, further comprising a control panel wherein the control panel is coupled by electrical communication to the one or more massaging units.

23. The massaging cushion of claim 22, wherein the control panel is located in either the elongate right armrest or the elongate left armrest.

24. The massaging cushion of claim 22, further comprising one more heating sources located within the backrest and controlled by the control panel wherein the control panel is coupled by electrical communication to the one or more heating sources.

25. The massaging cushion of claim 22, further comprising a power supply wherein the power supply is coupled by electrical communication to the control panel.

26. The massaging cushion of claim 25, wherein the power supply is a battery.

27. A massaging cushion, comprising:

a backrest having an elongate right side and elongate left side;

an elongate right armrest rotatably coupled to the elongate right side of the backrest;

an elongate left armrest rotatably coupled to the elongate left side of the backrest wherein the elongate right armrest and the elongate left armrest can rotate, while remaining coupled to the backrest, into a folded position with the elongate right armrest and elongate left armrest positioned adjacent to, and extending along, the elongate right side and the elongate left side of the backrest, respectively; and one or more massaging units located within the backrest;

wherein the elongate right armrest and the left elongate armrest rotate to a position between zero to one hundred and eighty degrees from the backrest.

28. A massaging cushion, comprising:

a backrest having an elongate right side and elongate left side;

an elongate right armrest rotatably coupled to the elongate right side of the backrest;

an elongate left armrest rotatably coupled to the elongate left side of the backrest wherein the elongate right armrest and the elongate left armrest can rotate, while remaining coupled to the backrest, into a folded position with the elongate right armrest and elongate left armrest positioned adjacent to, and extending along, the elongate right side and the elongate left side of the backrest, respectively; and one or more massaging units located within the backrest;

wherein the sitting position is formed by rotating the elongate right armrest and the elongate left armrest to a position between about forty-five to about one hundred and thirty-five degrees from the backrest.

29. The massaging cushion of claim 16 wherein the backrest is a fabric-covered, rectangular cushion.

30. The massaging cushion of claim 16, wherein the elongate right armrest and the elongate left armrest are coupled to the backrest by an axle running through a bottom portion of the backrest.

31. A seatless massaging bed cushion, comprising:

means for back support with two side edges;

two means for arm resting rotatably coupled directly to the means for back support wherein the two means for arm resting can rotate, while remaining coupled to the backrest, from a sitting position to a folded position, wherein the two means for arm resting rotate about respective axes extending transversely from the side edges of the means for back support; and one or more means for massaging within the means for back support.

32. A seatless massaging bed cushion for supporting a person in a sitting position, consisting essentially of:

a backrest with two elongate side edges;

two elongate armrests, each with a longitudinal axis, rotatably coupled to the backrest wherein the two armrests can rotate, while remaining coupled to the backrest, from a sitting position to a folded position, and wherein, in the folded position, the longitudinal axes of the armrests extend along the two side edges of the backrest;

one or more massaging units within the backrest; and a control panel wherein the control panel is coupled by electrical communication to the one or more massaging units.

* * * * *